US005636811A

United States Patent [19]

Crowther et al.

[11] Patent Number: 5,636,811

[45] Date of Patent: Jun. 10, 1997

[54] STRAPPING RECLAIMER

[76] Inventors: David Crowther, 1137 Dobler Road, Parksville, British Columbia, Canada, V9P 2C5; Albert H. Orcutt, P.O. Box 278, Errington, British Columbia, Canada, V0R 1V0; Terry L. Orcutt, 1412 Aurora Crescent, Comox, British Columbia, Canada, V9M 3C4

[21] Appl. No.: 390,658

[22] Filed: Feb. 17, 1995

[51] Int. Cl.[6] ..... B65H 19/18; B65H 18/00

[52] U.S. Cl. ..... 242/535; 242/551; 242/556

[58] Field of Search ..... 242/535, 551, 242/553, 554.4, 556, 471

[56] References Cited

U.S. PATENT DOCUMENTS

| | | | |
|---|---|---|---|
| 2,059,873 | 11/1936 | Jones et al. | 242/556 |
| 2,478,491 | 8/1949 | Lang | 242/556 |
| 3,064,869 | 11/1962 | Cooper | 242/556 |
| 3,166,266 | 1/1965 | Erskine | 242/556 |
| 3,966,133 | 6/1976 | Gelin | 242/42 |
| 4,011,807 | 3/1977 | Kobiella | 100/2 |
| 4,380,255 | 4/1983 | Fromm | 140/93.2 |
| 4,398,572 | 8/1983 | Fromm | 140/93.2 |
| 4,744,845 | 5/1988 | Posey | 242/556 |
| 4,826,093 | 5/1989 | Van Colen | 242/18 R |
| 5,022,595 | 6/1991 | Goekler | 242/7.23 |
| 5,318,646 | 6/1994 | Cardini et al. | 242/556 |
| 5,421,535 | 6/1995 | Hemmert et al. | 242/471 |
| 5,468,321 | 11/1995 | Van Liempt et al. | 242/553 |

FOREIGN PATENT DOCUMENTS

| | | | |
|---|---|---|---|
| 3430209 | 2/1986 | Germany | 242/556 |
| 1118464 | 10/1984 | U.S.S.R. | 242/471 |

*Primary Examiner*—John M. Jillions
*Attorney, Agent, or Firm*—Norman M. Cameron

[57] ABSTRACT

A strapping reclaimer includes a strapping feeder. There is a strapping joining station adjacent the feeder. A strapping reeling apparatus is adjacent the strapping joining station. Preferably the feeder includes a strapping straightener. The strapping joining station may include a pair of spaced-apart clamps. Preferably there is a member with a strapping receiving surface extending between the clamps. The member may have two portions mounted for moving apart to stretch joined lengths of strapping or to adjust gaps or degrees of overlapping therebetween. Strapping is reclaimed by feeding lengths of strapping successively to the work area. Adjacent lengths of strapping are joined together. The joined together lengths of strapping are then wound onto a reel.

9 Claims, 3 Drawing Sheets

STRAPPING RECLAIMER

BACKGROUND OF THE INVENTION

This invention relates to an apparatus and method for reclaiming strapping.

Strapping, of metal, reinforced plastic or other materials, is commonly used for packaging or securing goods. The goods are usually removed by cutting the strapping which is conventionally discarded. This is environmentally unsound because the materials in the strapping are essentially wasted and add to the volume of materials to be sent to a landfill dump or the like.

U.S. Pat. Nos. 4,380,255 and 4,398,572 describe devices used for connecting steel bands having band tensioning means.

U.S. Pat. No. 3,966,133 shows an apparatus adapted to control the tension in glass strands.

U.S. Pat. No. 4,826,093 shows an apparatus for winding an elongated element onto a reel. U.S. Pat. No. 5,022,595 shows a tensioning device. A strap feeding and tensioning machine is disclosed in U.S. Pat. No. 4,011,807.

However, the prior art does not reveal a method and apparatus for reclaiming strapping which has been widely adopted. Accordingly, it is an object of the invention to provide an improved apparatus and method for reclaiming strapping made of metal, plastic or other materials.

It is also an object of the invention to provide an improved apparatus and method for reclaiming strapping which are economical, reliable and suitable for widespread, commercial applications.

It is a further object of the invention to provide an improved apparatus and method for reclaiming strapping which produce a product capable of being reutilized for subsequent strapping operations.

SUMMARY OF THE INVENTION

In accordance with these objects, there is provided a strapping reclaimer which includes a strapping feeder. There is a strapping joining station adjacent the feeder. There is also a strapping reeling apparatus adjacent the strapping joining station.

Preferably the strapping joining station includes a pair of spaced-apart clamps. There may be a member having a band receiving surface extending between the clamps. In one preferred embodiment, the member has two movably connected portions.

According to the invention there is also provided a method of reclaiming strapping. The method includes feeding lengths of strapping successively to a work area. Adjacent lengths of strapping are joined together. The joined together lengths of strapping are wound onto a reel.

Preferably, the adjacent lengths of strapping are clamped in an aligned position while being joined together.

In one preferred embodiment of the invention, the joined together lengths of strapping are joined by a joint, the joint being stretched to lock the lengths together.

DESCRIPTION OF THE PREFERRED EMBODIMENTS

Figure 1:
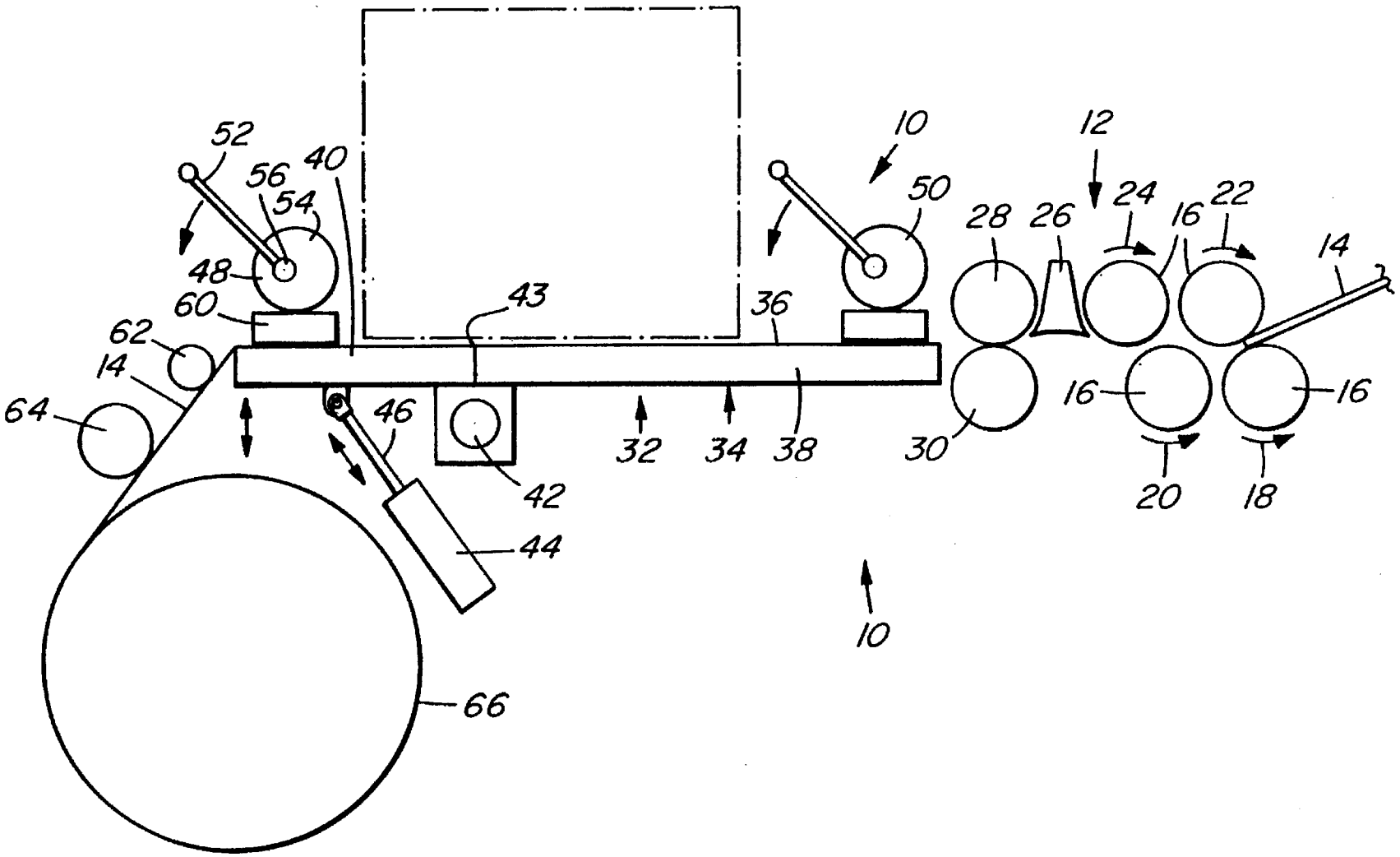
FIG. 1 is a simplified, side view of an apparatus for reclaiming strapping according to an embodiment of the invention.

Referring to the drawings, and first to FIG. 1, this illustrates a strapping reclaimer shown generally at 10. The reclaimer has a feeder 12 for feeding strapping 14, typically of metal, reinforced plastic or possibly other materials. The apparatus is also suitable for reclaiming other types of bands or strips which are also included within the definition of "strapping" herein. In this particular instance the feeder 12 has a first section comprising four straightening rolls 16 which engage the strapping and remove kinks and bends. The straightening rolls rotate in the directions indicated by arrows 18, 20, 22 and 24 so as to engage the strapping and move it to the left from the point of view of the drawing.

A guide shoe 26 is positioned adjacent to the straightening rolls so the strapping passes over the guide shoe after the straightening section. There is a pair of feed rolls 28 and 30 on the opposite side of the guide shoe from the straightening rolls. These engage the strapping and move it further to the left, from the point of view of FIG. 1, to a work area 32.

The work area includes a table-like member 34 with a flat, horizontal surface 36 positioned so the strapping passes over the surface 36 as it moves further to the left from the point of view of FIG. 1. The member 34 has two portions 38 and 40 which are pivotally connected by a hinge 42. There is a gap 43, shown closed, between the portions. A fluid cylinder is connected to portion 40 by its rod 46. The rod is illustrated in its extended position. When retracted by the cylinder, the rod causes section 40 to rotate about hinge 42 away from the strapping 14.

A pair of clamps 48 and 50 are mounted on portions 38 and 40 of the member 34 respectively. The illustrated type of clamp is manually operated by means of handle 52 connected to an eccentric roller 54. The roller can rotate about a pivot point 56. Thus, when the handles are rotated clockwise from the point of view of FIG. 1, the effect is to secure the strapping 14 between the clamps and a plate 60 to hold the strapping in position.

There is a counter 62 located to the left of the work area, from the point of view of FIG. 1, which counts the length of joined strapping produced as a product. There is also a print wheel 64 for marking the strapping. A reel 66 is positioned at the opposite end of the apparatus to the feed area for collecting the joined together strapping. The reel is rotated counter clockwise, from the point of view of FIG. 1, by a conventional rotating mechanism.

Figure 2:
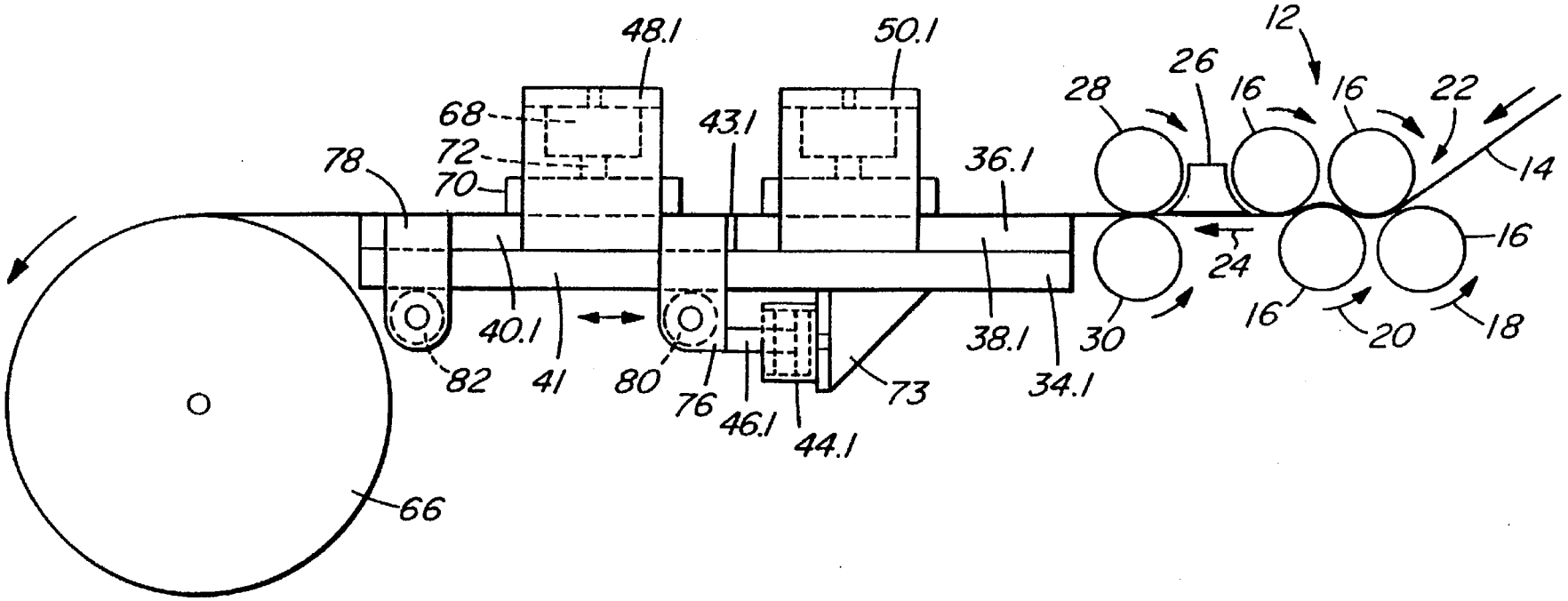
FIG. 2 is a enlarged, side view of an apparatus for reclaiming strapping according to an alternative embodiment thereof.
Figure 3:
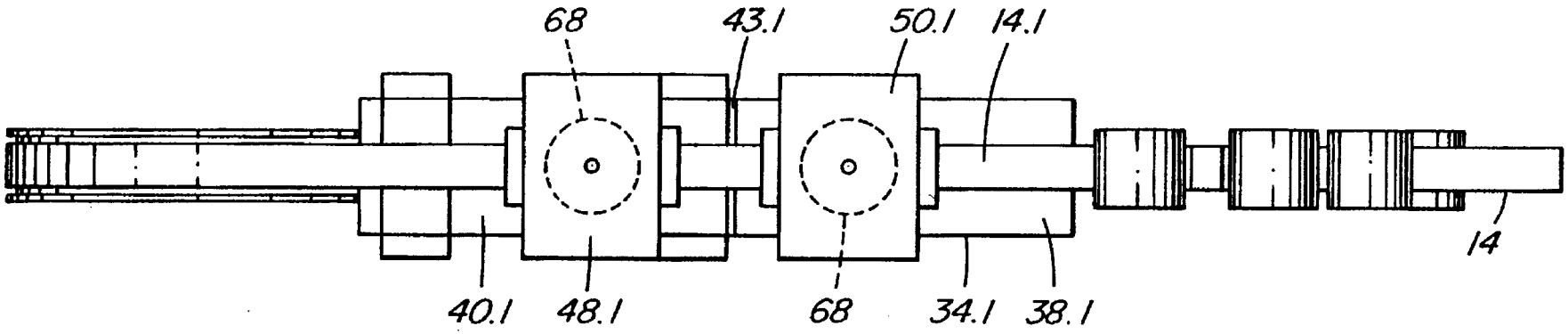
FIG. 3 is a top plan thereof.

An alternative embodiment is illustrated in FIG. 2 and 3 where like parts have like numbers with the additional designation "0.1". In this example, table-like member 34.1 also has two portions 38.1 and 40.1. However, these sections are not hingedly connected as in the previous embodiment, but are slidably mounted on a guide rail 41 for back and forth axial movement along the strapping. In the illustrated position, portions 38.1 and 40.1 are separated by a gap 43.1.

This embodiment also has a pair of clamps 48.1 and 50.1. However these clamps are powered by means of fluid cylinders 68 connected to a member 70 by a rod 72. The strapping passes between the members 70 and the portions 38.1 and 40.1 of the member 34.1.

In this example cylinder 44.1 is mounted on a bracket 73 connected to portion 38.1 of member 34.1. Cylinder rod 46.1 is connected to a U-shaped bracket 76 connected to portion 40.1 and extending slidably above and below rail 41. There is a similar bracket 78 at the opposite end of the portion 40.1. Rollers 80 and 82 are rotatably mounted on the brackets below rail 41 to support portion 40.1 and allow reciprocation thereof on the rail 41.

Operation

Referring first to FIG. 1, strapping is reclaimed by feeding lengths of strapping 14 first into the straightening rollers 16, over the guide shoe 26, through the feed rolls 28 and 30 and over the surface 36 of member 34. During this portion of the operation, the clamps 48 and 50 are open.

The strapping is moved to the left, from the point of view of FIG. 1, until the left end of the length of strapping is over the gap 43, then closed as shown in FIG. 1. At this point, clamp 48 is closed by rotating handle 52 clockwise to secure the strapping between roller 54 and plate 60.

Figure 4:
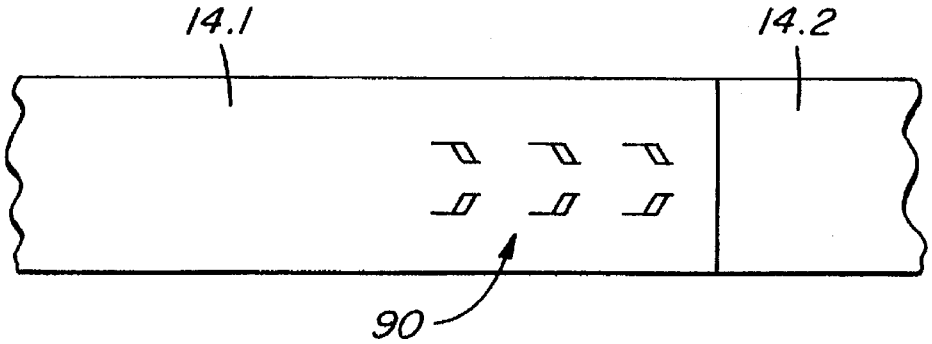
FIG. 4 is a top plan of two lengths of strapping joined together with a mechanical joint.

Another length of strapping 14 is then fed to the left until its right end, from the point of view of FIG. 1, is adjacent the closed gap 43. The exact positions of the ends of the strapping depend upon the type of strapping and the method of connection. However generally the two ends should be adjacent each other over the closed gap 43. Clamp 50 is then closed to secure the second length of strapping in place. A conventional punch-lock joint 90, as seen in FIG. 4 for example, can be then used to connect the two lengths of strapping together. After this joint is formed, cylinder 44 is used to pivot portion 40 of member 34 away from the strapping to open gap 43 and stretch the joined strapping to thus lock the two lengths 14.1 and 14.2 together.

Instead of a mechanical punch-lock connection, the two lengths of strapping can be welded together. If so, the cylinder 44 can be used to form the correct gap at 43 for the welding operation. Alternatively, when the apparatus is used for plastic strapping, a plastic thermal joint may be used to join the lengths of strapping together. In that instance, the cylinder can be used to set the proper degree of overlap for the joint.

After the two lengths of strapping are joined together, the clamps 48 and 50 are released and reel 66 can be rotated counter clockwise from the point of view of FIG. 1, to wind the joined sections of strapping onto the reel. The counter 62 keeps track of the length of the strapping on the reel, while print wheel 64 can print the reclaimed strapping with any desired marking.

The process is then repeated using additional lengths of strapping until the reel 66 is full. It is then removed and replaced by an empty reel and the process again repeated.

With reference to FIG. 2, the process utilized is essentially the same. However the strapping is stretched or the gap or degree of overlap adjusted by axial movement of the portions 38.1 and 40.1 of member 34.1. In addition, the clamps 48.1 and 50.1 are engaged or released by the cylinders 68 instead of by manual operation.

It will be understood by someone skilled in the art that many of the details provided above are by way of example and are not intended to limit the scope of the invention which is to be interpreted with reference to the following claims.

What is claimed is:

1. A strapping reclaimer, comprising;

a strapping feeder;

a strapping joining station adjacent the feeder including a pair of spaced-apart clamps and a member with a strap receiving surface extending between the clamps, the member having two portions connected by a hinge between the clamps; and a strapping reeling apparatus adjacent the strapping joining station.

2. A reclaimer as claimed in claim 1, wherein one of the portions is hinged for pivoting.

3. A reclaimer as claimed in claim 2, wherein the one portion is pivotable in a direction away from strapping received on the surface.

4. A reclaimer as claimed in claim 3, wherein the clamps are mounted on the portions of the member.

5. A reclaimer as claimed in claim 4, wherein the member is a table and the surface is flat and horizontal. are joined by a joint, the joint being stretched to lock the lengths together.

6. A method of reclaiming strapping, comprising;

feeding lengths of strapping successively to a work area;

clamping adjacent lengths of strapping in an aligned position;

joining said adjacent lengths of said strapping together by a joint;

stretching the joint to lock the lengths together; and winding joined together said lengths of stropping onto a reel.

7. A method as claimed in claim 6, wherein the lengths of strapping are clamped on each side of the joint.

8. A method as claimed in claim 7, whereto the lengths of strapping are laid on a flat surface having two pivotally connected portions, the joint being stretched by pivoting the portions of the surface.

9. A method as claimed in claim 7, wherein the lengths of strapping are laid on a flat surface having two portions, one said portion being movable along the strapping away from another said portion, the joint being stretched by moving clamped joined lengths of strapping away from each other by moving the portions of the surface away from each other.

* * * * *